United States Patent [19]

Freelander et al.

[11] 4,170,083

[45] Oct. 9, 1979

[54] TOY CONSTRUCTION

[75] Inventors: Israel R. Freelander, 6 Spring Valley Dr., Worcester, Mass. 01609; Jerrold J. Krumholz, East Orange, N.J.

[73] Assignee: I. Robert Freelander

[21] Appl. No.: 840,236

[22] Filed: Oct. 7, 1977

[51] Int. Cl.[2] ..... A63H 33/10

[52] U.S. Cl. ..... 46/29; 46/17

[58] Field of Search ..... 46/31, 30, 29, 23, 17, 46/16, 28, 27, 26, 22, 223; 403/161, 208, 173, 169, 170

[56] References Cited

U.S. PATENT DOCUMENTS

| | | | |
|---|---|---|---|
| 1,984,799 | 12/1934 | Jacobson | 46/16 UX |
| 2,095,700 | 10/1937 | Heede | 46/29 |
| 2,426,326 | 8/1947 | Tooms | 46/29 |
| 2,810,233 | 10/1957 | Jakobsen | 46/28 |
| 2,862,321 | 12/1958 | James | 46/31 X |
| 3,195,266 | 7/1965 | Onanian | 46/29 X |
| 3,224,136 | 12/1965 | Moryl | 46/31 X |
| 3,224,137 | 12/1965 | Wright et al. | 46/26 |
| 4,054,393 | 10/1977 | Talleri | 46/29 X |

FOREIGN PATENT DOCUMENTS

| | | | |
|---|---|---|---|
| 1195407 | 11/1959 | France | 46/28 |

*Primary Examiner*—Louis G. Mancene
*Assistant Examiner*—Mickey Yu
*Attorney, Agent, or Firm*—Salter & Michaelson

[57] ABSTRACT

A toy construction set is provided that includes a plurality of strap members that are assembled together to produce various constructional forms. A base member in the form of a platform, box or similar unit may also be provided with a plurality of outwardly extending buttons or projections that preferably are arranged in rows and in different spacial locations on the base. The straps are formed with rounded terminal ends having circular openings therein through which the projections are snapped so that the straps may be frictionally connected to the base at both ends thereof via the projections, thereby spanning a portion of the base. Connecting elements are also utilized to connect the straps at the ends thereof in producing certain shapes and forms.

7 Claims, 13 Drawing Figures

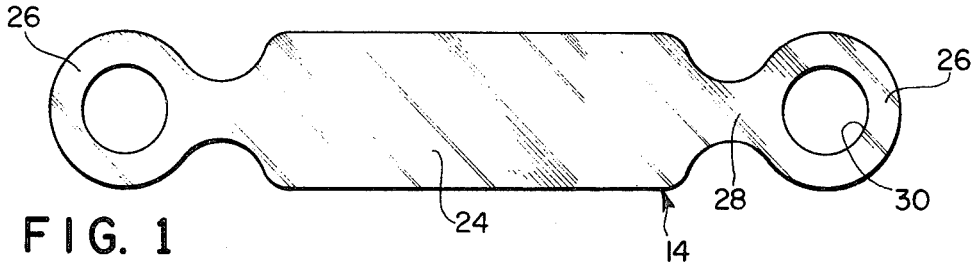
FIG. 1
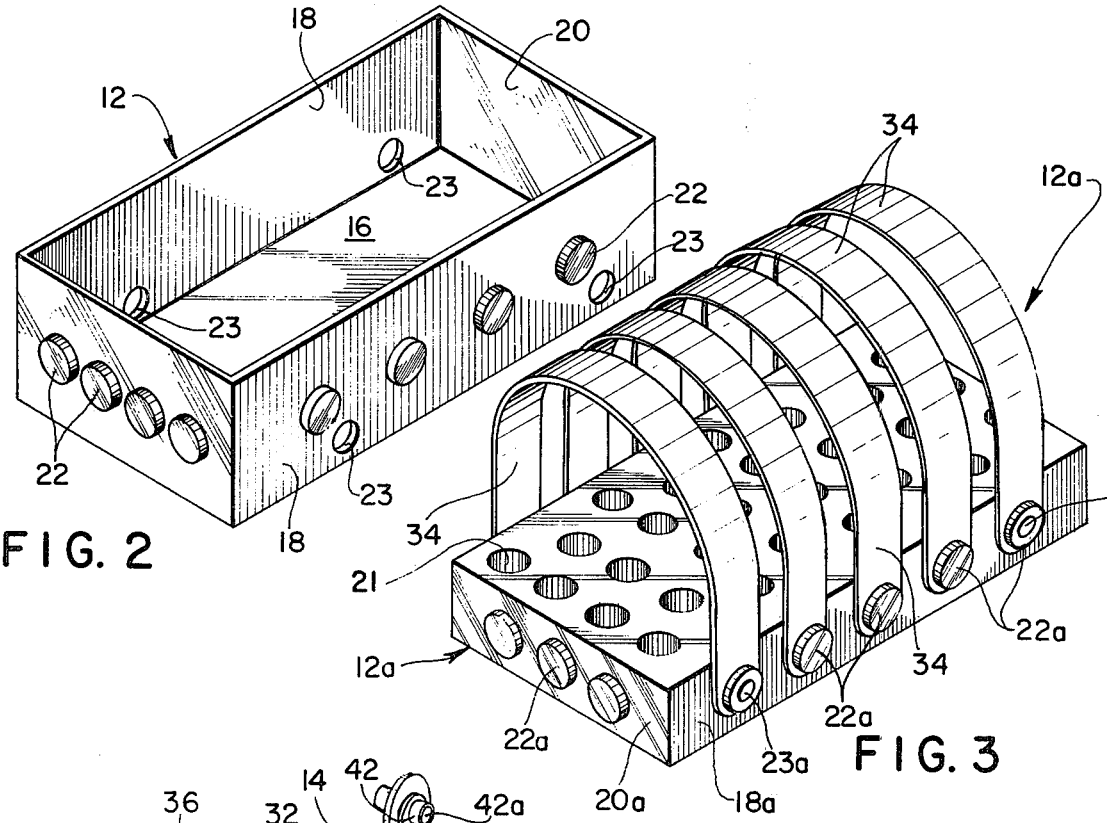
FIG. 2
FIG. 3
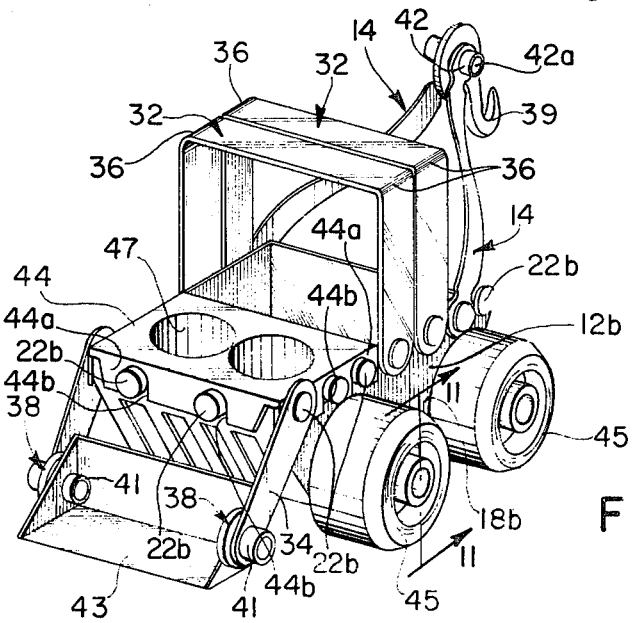
FIG. 4
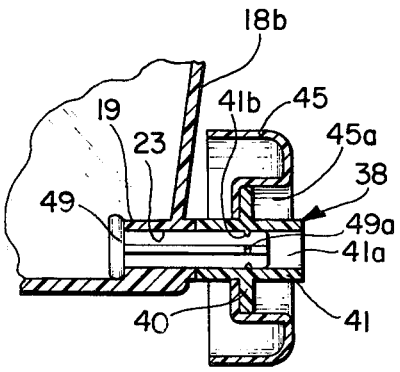
FIG. 11

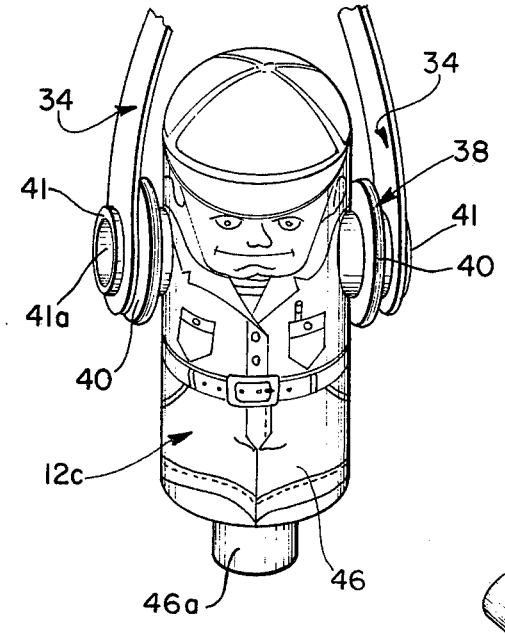
FIG. 7
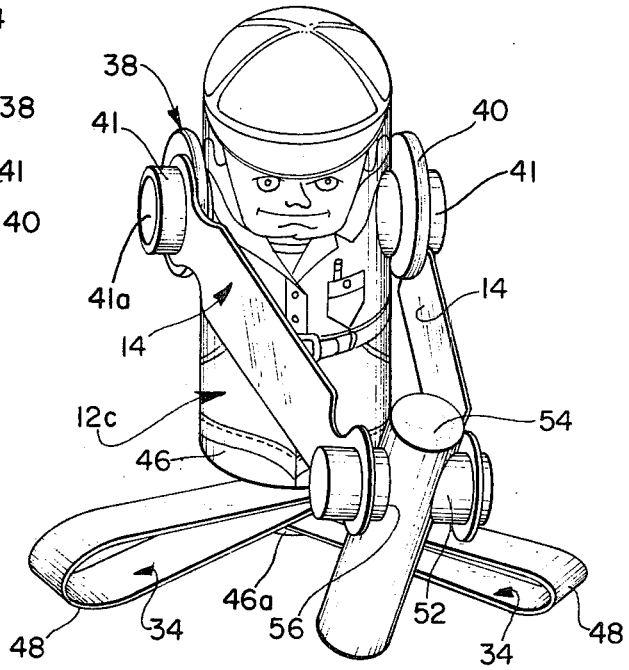
FIG. 8
FIG. 9
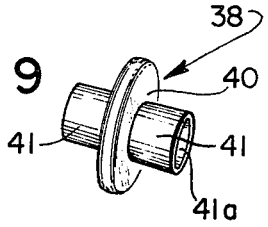
FIG. 10
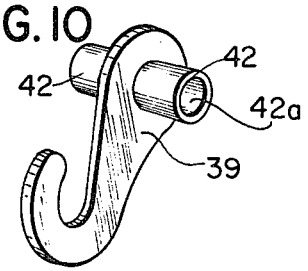
FIG. 5
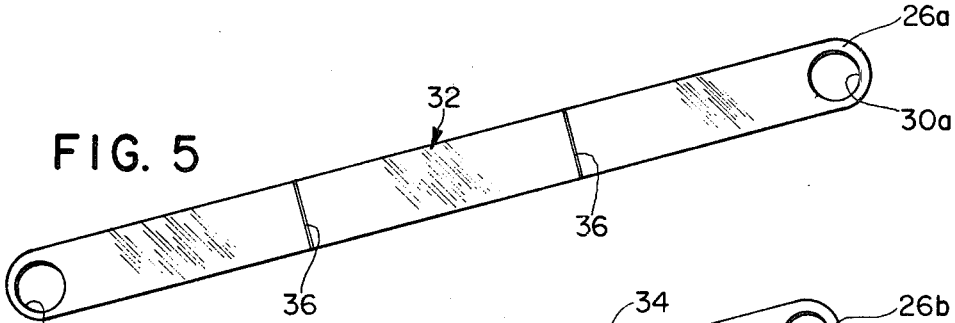
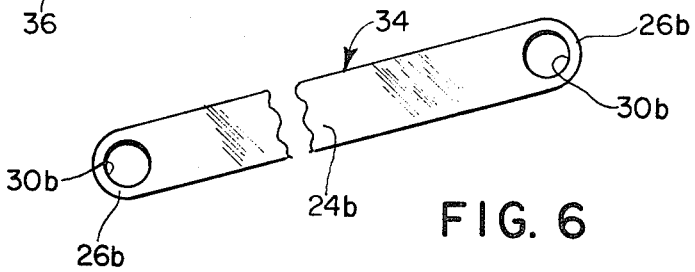
FIG. 6

TOY CONSTRUCTION

BACKGROUND AND SUMMARY OF THE INVENTION

The present invention relates to assembly toys and particularly to toy construction sets which utilize a plurality of flexible straps which are adapted to interconnect with base members in such a manner so as to form a wide variety of assembled constructions from a relatively small number of different construction pieces. Toy assembly sets of this general nature are known, as illustrated in U.S. Pat. No. 3,604,145, which shows a strap unit formed of plastic material that is deformable for arrangement in a variety of positions. Each of the strap units in U.S. Pat. No. 3,604,145 includes a plurality of cup-shaped sockets which also define projections, the idea being that the straps may be interconnected to each other by the mounting of a projection in a socket or vice versa. Another patent of interest is U.S. Pat. No. 2,791,868 which shows a constructional toy having a frame formed of plastic material and provided with openings as well as buttons thereon, the buttons cooperating with openings formed on another frame for the interconnection of the frames to each other. Still another patent of interest is U.S. Pat. No. 2,959,888 which discloses a flexible strap in the form of a bar having discontinuous end portions. Other patents of general interest are U.S. Pat. Nos. 731,309; 1,860,627; 2,943,415; 3,528,192 and 3,594,940.

It is a primary object of the present invention to provide a toy construction set having increased assembly flexibility, wherein a variety of interesting assembled constructions may be formed from a small number of basic elements.

A still further object of the present invention is to provide a toy construction set of the assembly type wherein a plurality of flexible strap units are interconnected by basic elements to form a variety of constructional configurations.

A further object of the present invention is the provision of an assembly toy having a plurality of base units each provided with a plurality of outwardly extending projections adapted to frictionally receive terminal end portions of connecting straps, and wherein the base members may be of different configuration and are capable of secondary interconnection with each other so as to enhance the play value of the toy.

These and other objects of the present invention are accomplished by providing a primary base unit having a plurality of equal diameter cylindrical projections extending outwardly therefrom. Each of the projections is locatable with respect to the base unit in at least two different spacial positions thereof and receives an elongated, substantially flat, flexible, thin strap thereon, the opposite terminal ends of which are provided with circular openings. The circular opening in each strap frictionally receives an outwardly extending projection thereon for mounting the strap on the base unit. Each strap may also include weakened lines that provide for bending the end portions of the straps to locate the straps in a variety of positions on the base unit. The base unit may also take the form of a simulated toy figure wherein the projections extend outwardly in opposite directions from shoulder locations and wherein a single strap is adapted to interconnect with said projections to form an overlying suspension means for said toy figure.

The simulated toy figure may further be used as a secondary base unit for positioning on a primary base unit.

In a simplified version of the invention, the base unit is eliminated, and selected straps are interconnected by connecting pieces to form a figure or design as desired.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a plan view of one form of a strap which may be incorporated in the construction toy of the present invention;

FIG. 2 is a perspective view of one form of a base member utilized in the construction toy;

FIG. 3 is a perspective view of an alternate form of a base member to which a plurality of straps are interconnected;

FIG. 4 is a perspective view of a still further form of a base member which cooperates with straps and other members to simulate a toy vehicle such as a front end loader;

FIG. 5 is a plan view of another form of strap unit;

FIG. 6 is a plan view of still another form of strap unit;

FIG. 7 shows an alternate form of a base unit that simulates a toy figure and to which a strap is interconnected to form a suspension means;

FIG. 8 is a perspective view of the toy figure shown in FIG. 7 supported at the bottom thereof by a plurality of straps and depicted in a work position;

FIG. 9 is a perspective view of an alternate connecting piece;

FIG. 10 is a perspective view of a hook portion used in the toy;

FIG. 11 is a sectional view taken along line 11—11 in FIG. 4;

DESCRIPTION OF THE INVENTION

Figure 12:
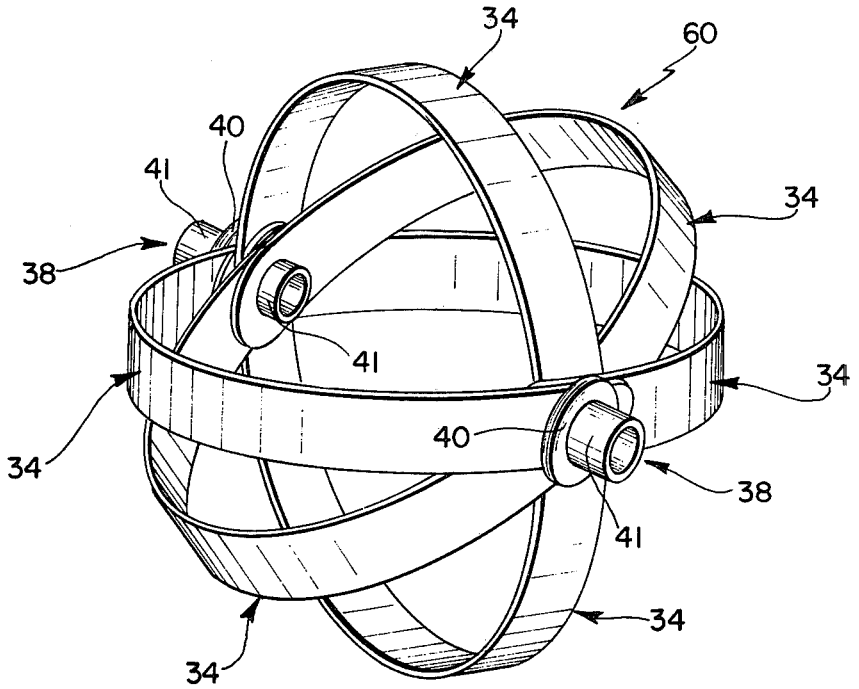
FIG. 12 is a perspective view of an article that is formed by interconnecting straps with connecting pieces, but that does not include a base unit.

Referring now to the drawings and particularly to FIG. 2, one form of a base member as embodied in the present invention is generally indicated at 12 and is adapted to accommodate a plurality of strap members, one of which is generally indicated at 14 in FIG. 1. The base member 12 may be of any desired configuration such as a four-sided box or container as shown in FIG. 2, the block or platform **12*a* as shown in FIG. 3, the toy vehicle body or base unit 12*b* as shown in FIG. 4, and the body in the form of a toy figure 12*c* as shown in FIGS. 7 and 8**.

The base 12 illustrated in FIG. 2 includes a bottom wall 16 and upwardly extending side and end walls 18 and 20, respectively. The side and end walls 18,20 are further provided with a plurality of buttons or projections 22 that are secured to the outer surfaces thereof. The projections 22 are circular in configuration and are preferably formed in longitudinally oriented rows, wherein at least two rows as located on spaced, parallel walls are in aligned opposition to each other, such as the row of projections 22 shown on a side wall 18 of base member 12 and those projections (not visible) projecting outwardly from the other parallel side wall 18 opposite thereto. It is contemplated that the base 12 be used for simulating a vehicle; and in order to provide for mounting of an axle and wheels thereon, small holes 23 are formed in the side walls 18. The base 12*a* is constructed somewhat similar to base 12 and includes rows of projections 22*a* that extend outwardly from the side and end walls 18*a* and 20*a*, respectively thereof. However, the end projections 22*a* of the walls 18*a* are formed with openings 23*a* therein that accomodate an axle and wheel assembly as will be described hereinafter. Formed in the upper surface of the base 12*a* are a plurality of sockets or openings 21 that accommodate pegs or connecting discs that will be described hereinafter. The base 12*b* also includes a row of projections 22*b* extending from opposite walls 18*b* of the simulated vehicular construction. The walls 18*b* having openings formed therein for receiving an axle and wheel assembly as will also be described hereinafter.

Referring again to FIG. 1, the construction of the strap unit 14 is best illustrated as including an elongated central portion 24 having opposed terminal ends 26, each connected thereto by means of a significantly narrowed or necked-in connecting portion 28. The terminal ends 26 are rounded and each is formed with an opening 30 of circular configuration that is of a diameter to closely and frictionally interfit with the outside diameter of the projections 22,22A and 22*b*. In this manner, then, a plurality of the straps 14 may be connected to the base members 12, 12*a*, 12*b* or 12*c* by the frictionally interfitting of one or both of the terminal ends 26 over one or more of the projections. The straps may be formed in other configurations and lengths such as strap generally indicated at 32 shown in FIG. 5 and strap generally indicated at 34 shown in FIG. 6. In both of these latter straps the reduced end necks have been eliminated, the strap 32 also including ends 26*a* having holes 30*a* formed therein, and strap 34 having ends 26*b* in which holes 30*b* are formed.

The straps of the configuration illustrated by straps 14, 32, or 34 may be interconnected with the base members 12, 12*a*, 12*b* and 12*c* in a variety of ways, perhaps the most common manner being illustrated in FIG. 3, wherein a plurality of straps 34 are upwardly bowed and thus span or bridge the upper surface of the base 18*a*. In this regard one terminal end 26*b* is interengaged with one side wall 18*a* so that a projection 22*a* extends outwardly from the opening 30 in frictional relation. The opposite terminal end 26*b* is also mounted on a projection 22*a* and is secured to the opposite side wall 18*a*; and by similarly locating a series of straps 34 in parallel relation, a simulated protective canopy or housing is formed over the base 18*a*. The strap 32 may further be formed with fold or weakened lines 36 which transversely extend entirely across the central portion thereof, the strap 32 being more easily bent in an angular configuration at the fold lines 36 to form a modified configuration, one example of which is a hood or canopy construction as shown in FIG. 4. One or more of such weakened lines 36, may be provided within a single strap as illustrated in FIG. 5.

It is also seen that several of each of the strap units 14, 32 and 34 may be provided in a toy assembly or kit, depending on the size or number of different constructions which are intended to be assembled thereby. Similarly, a plurality of base units, including those of the different configurations illustrated, may also be included in such a kit. Further, some or all of the various sized straps 14, 32 and 34 may be provided with weakened lines 36 or not, as suited to the particular purpose. Other connecting elements are further illustrated in FIGS. 9 and 10, a connecting disc 38 being shown in FIG. 9 and a hook element 39 being illustrated in FIG. 10. The connecting disc 10 includes a disc portion 40 to which opposed projections 41 are joined, an opening 41*a* extending through the projections 41. Similarly formed opposed projections 42 are also fixed to the opposite sides of the hook element 39 and an opening 42(*a*) extends therethrough. As will be described, both the disc 38 and the hook portion 39 are utilized as accessory pieces in the construction set.

In the assembly of the elements to simulate a particular apparatus, the reduced connecting portion 28 of the strap 14 has special application when positioned on a projection in close adjacent relation to another projection. In such case the lateral extent by which the strap 14 may be angularly pivoted with respect to the adjoining projection is increased by the configuration of the connecting portion 28. This is more clearly illustrated in FIG. 4 wherein the hook portion 39 is mounted in place by straps 14 that engage the projections 42 thereof. The opposite ends of the straps 14 are mounted on opposed projections 22*b*, and because of the reduced or necked-in portion 28, the straps 14 may be pivoted to elevate and lower the hook portion as desired. When such an arcuate movement is either not desirable or would not be limited as by the absence of an adjoining projection 22, the strap 34 can be employed. In this connection, straps 34 may be attached to the projections 41 of discs 38 that are secured in appropriate openings in a simulated bucket portion 43 of the front-end loader illustrated in FIG. 4. The opposite ends of the straps 34 are mounted on projections 22*b* located on a platform 44 that is received in the interior of the base 12*b* that defines the body of the simulated front-end loader. As shown in FIG. 4, the platform 44 is formed with side and end walls 44*a* having slots 44*b* that accomodate the projections 22*b* therein for locating the platform in place on the base 12*b*. It should also be pointed out that whereas a primary base unit such as base 12 would normally be included in a constructional set or kit, secondary base units such as the bucket 43 may also be incorporated and such secondary base units may also incorporate projections 22 in a manner and for similar purposes as those provided in the primary base units 12. As further shown in FIGS. 4 and 11, the front-end loader as illustrated is provided with wheels 45, each of which is formed with a central recess 45*a* therein. The sidewalls 18*b* of the base 12*b* is formed with interior bosses 19 adjacent to the ends thereof in which openings 23*b* are located. An axle member 49 having a cross-shaped cross-sectional configuration and a head formed thereon extends through the opening 23 with the head thereof abutting against the interior end of the boss 19. A recess 49*a* is formed on each web of the axle member 49 adjacent to the end thereof and receives therein an annular interior flange 41*b* formed in the opening 41*a* of the connecting disc 38 for positively locating the wheel 45 in place on the axle member 49.

The simulated toy figure 12*c* shown in FIGS. 7 and 8 may alternatively form either a primary or secondary base unit. Thus, the figure 12*c* is formed with a generally cylindrical body 46 having a reduced bottom projecting portion 46*a*. The configuration of the body 46 enables it to be received in a circular recess in a base, examples of which are illustrated as recesses 47 that are formed in the platform 44 mounted on the base **12*b* (FIG. 4). Referring again to FIGS. 7 and 8, the body 46 of the toy figure 12*c* further includes openings formed therein adjacent to the upper end thereof into which projections 41 of the connecting discs 38 are inserted, leaving the opposed projections 41 exposed. Pivotally mounted on the exposed projections are straps 14 that simulate arms of the toy figure. In order to locate the toy figure 12*c* in a standing position, straps 34 bent upon themselves are secured to the downwardly projecting portion 46*a* and form outwardly extending supporting legs 48. The legs 48 are utilized to support the toy figure 12*c* either unassisted or in a work position such as illustrated in FIG. 8. As further illustrated in FIG. 8, the straps 14 that simulate the arms of the toy figure are connected at the outer ends thereof to a laterally extending peg 52 which is mounted on a vertically extending member 54 formed with an opening 56 through which the peg 52 extends. The work stance of the FIG. 12*c* thus simulates that of a jackhammer operator. Of course, a wide variety of other positions may be simulated, and for this purpose pegs with or without openings 56 such as the peg 52 and the member 54 may be provided as units in the constructional assembly kit of the present invention. In FIG. 7, straps 34 are connected to the connecting discs 38 and are shown in an overhead pivoted position. The outermost ends of the straps 34** may be connected to any convenient member as desired.

Figure 13:
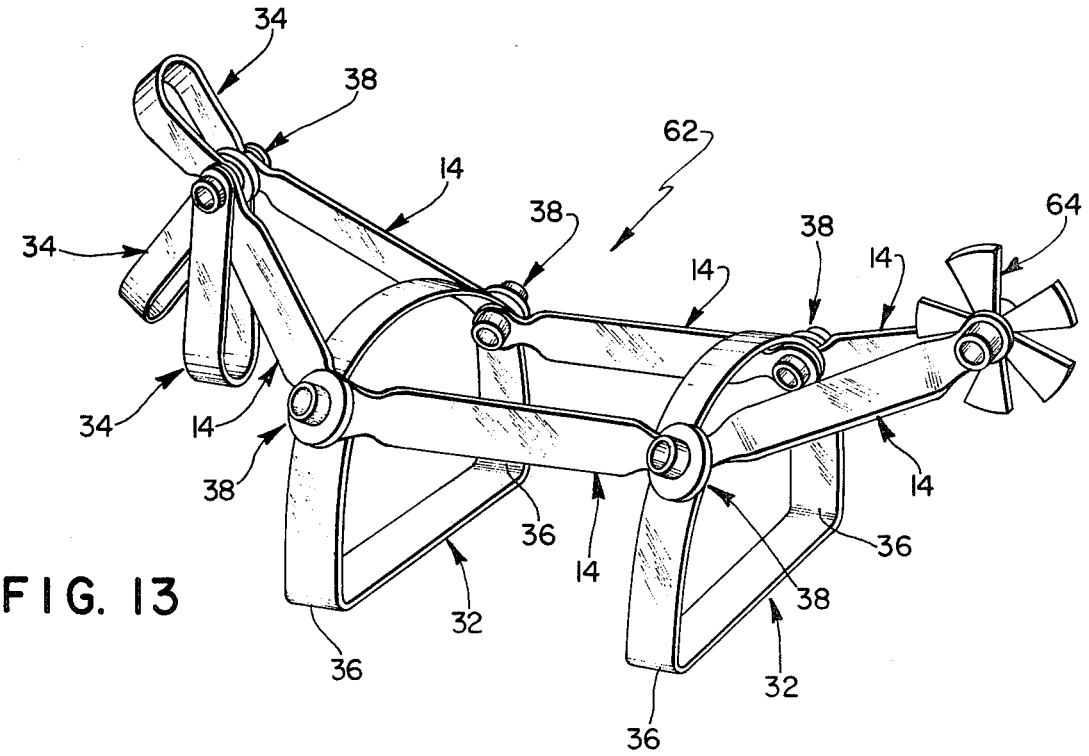
FIG. 13 is a perspective view of another article that is formed without the use of a base unit.

Referring now to FIGS. 12 and 13 additional forms of the invention are illustrated, wherein only straps and connecting elements are utilized to form a figure or article thereby avoiding the use of a base member. As shown in FIG. 12, a spherical member generally indicated at 60 is formed by interconnecting a plurality of straps 34 to spaced connecting discs 38. The end holes **30*b* as formed in the straps 34 are mounted on the innermost located projections 41 of each disc 38, and the straps 34 are disposed in spaced apart relation to simulate the spherical member 60**.

In FIG. 13, a standing animal figure is simulated and is generally indicated at 62. The FIG. 62 is formed by locating a pair of straps 32 in spaced relation, using the center portion of the straps between the fold lines 36 as the supports for the figure. A pair of horizontal straps 14 are interconnected to the strap 32 at the upper ends thereof through connecting discs 38, a pair of straps 34 being joined to the connecting discs 38 in bowed relation and completing the body portion of the FIG. 62. The neck of the FIG. 62 is formed by forwardly extending straps 14 that are connected to a disc 38 at the outermost ends thereof, the head of the figure being simulated by reversely bending three straps 34 and connecting them to the adjacent disc 38. The tail of the FIG. 62 is simulated by connecting two additional straps 14 to the rear discs 38 at the inner ends thereof and to a fan type connecting disc generally indicated at 64 at their outer ends. It is seen that both the FIGS. 60 and 62 are formed by only straps and connecting discs, thereby avoiding the use of a base member, as previously described and illustrated in FIGS. 2, 3, 4, 7, and 8.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy construction set, comprising a base unit having at least one generally flat planar surface to which flat side walls are joined in perpendicular relation with respect thereto, a plurality of outwardly extending projections of circular cross section disposed in spaced apart relation on at least a pair of said side walls that are located in opposed, parallel and spaced relation, and a plurality of elongated, substantially flat, generally thin flexible straps, each of said flexible straps having opposed terminal ends in each of which an opening is formed, the diameter of which generally corresponds to that of said projections, the ends of each strap being connectable with a projection by the force fitting of the opening therein over the exposed projection, wherein said straps are mounted in frictional engagement on said projections and span at least a portion of said base unit in overlying relation thereto.

2. The toy construction set of claim 1, said strap terminal ends being rounded.

3. The toy construction set of claim 1, wherein at least two of said base projections are relatively closely spaced side by side with respect to each other, and a plurality of said straps wherein at least some of said straps include a necked-in connecting portion between the terminal end and elongated central portions thereof, said necked-in connecting portion providing for wider lateral non-contacting arcuate pivotal movement of the strap on which it is formed toward a projection that is located laterally adjacent to that projection to which said strap is connected for said pivotal movement.

4. The toy construction set of claim 1, said projections being separated from each other in longitudinally oriented rows, and said rows being positioned at different spacial locations on said base, at least two of said rows being in spaced, generally parallel opposed relation to each other, and wherein said straps are adapted for connections at opposite ends thereof respectively with opposed projections in said parallel rows thereof so that said strap spans that base portion intermediate said parallel rows of projections.

5. The toy construction set of claim 1, wherein at least some of said straps include an elongated central portion, said central portion being bendable in a plane disposed generally normal to that passing through said strap when it is located in a flat position.

6. The toy construction set of claim 4, at least some of said straps having spaced, weakened lines that are transversely disposed at spaced locations entirely across said strap in said elongated central portion thereof, said strap being bendable about said weakened lines.

7. The toy construction set of claim 5, said base unit being a toy vehicle, a plurality of said straps being connected at opposite ends thereof to said projections of opposed rows thereof, said straps being disposed generally parallel to each other, so as to form a simulated protective cover for said vehicle.

* * * * *